United States Patent [19]

Allen et al.

[11] 4,124,074

[45] Nov. 7, 1978

[54] METHOD FOR FORMING A GRAVEL PACK IN TAR SANDS

[75] Inventors: Joseph C. Allen, Bellaire; Bobby G. Harnsberger, Houston, both of Tex.

[73] Assignee: Texaco Inc., New York, N.Y.

[21] Appl. No.: 748,979

[22] Filed: Dec. 9, 1976

[51] Int. Cl.[2] ..... E21B 43/04

[52] U.S. Cl. ..... 166/278; 166/51

[58] Field of Search ..... 166/278, 301, 51; 299/2, 5, 17

[56] References Cited

U.S. PATENT DOCUMENTS

| | | | |
|---|---|---|---|
| 1,612,611 | 12/1926 | Claytor | 299/17 X |
| 2,213,962 | 9/1940 | Layne | 266/278 |
| 2,452,654 | 11/1948 | Hayes et al. | 166/278 |
| 2,513,944 | 7/1950 | Kessler | 166/278 |
| 3,913,675 | 10/1975 | Smyrl | 166/51 X |
| 3,951,457 | 4/1976 | Redford | 299/5 |

FOREIGN PATENT DOCUMENTS

| | | | |
|---|---|---|---|
| 576,831 | 5/1933 | Fed. Rep. of Germany | 175/314 |

*Primary Examiner*—Ernest R. Purser
*Attorney, Agent, or Firm*—Carl G. Ries; Thomas H. Whaley; Theron H. Nichols

[57] ABSTRACT

A process and system are disclosed for producing bitumen from a subterranean reservoir of tar sands as unconsolidated oil bearing sands. The process comprises basically (1) washing out a cavity in the formation to the bottom thereof, (2) pouring a graded gravel in the cavity for building a conical shaped gravel pack, (3) running a screen down through the apex of the cone to the cavity bottom to bury the screen, (4) ejecting hot fluids into the cavity for melting bitumen from the tar sands, and (5) flowing the melted bitumen through the gravel pack and screen for filtering out sand and gravel from the melted bitumen for recovering the bitumen at the surface. A system for producing bitumen from tar sands is disclosed, and a method for forming a gravel pack in an unconsolidated oil bearing sand formation is disclosed.

2 Claims, 3 Drawing Figures

GRAVEL PACK SLURRY
LIQUIDS
21
22
19
11
12
23
24
20
13
TAR SAND FORMATION
14 — BEDROCK
— SHALE —

HIGH PRESSURE HOT AQUEOUS FLUIDS
16
HOT FLUIDS, BITUMEN AND SAND
19
18
15
10
11
12
17
20

BITUMEN
HOT AQUEOUS FLUIDS
16
27
26
11
25
26a
26b
24
20
SHALE 12
TAR SAND FORMATION 13
BEDROCK 14

METHOD FOR FORMING A GRAVEL PACK IN TAR SANDS

BACKGROUND OF THE INVENTION

Sand control is needed for unconsolidated oil bearing sands. Unconsolidated sands have little mechanical competency. Many of these formations contain heavy oil with the sand literally floating therein. Typical ones are the Alberta Oil (Tar Sands) of Athabasca, Wabsicaw, Peace River, Cold Lake and Frog Lake. It is impossible to gravel pack in a conventional manner and maintain the gravel in place due to the formation being unable to hold the gravel in place. The control of heavy oil or tar sands or sand suspended in oil or where tar is the matrix is difficult as the conventional sand control and production methods are not adequate and effective. In tar sands, the sand becomes unconsolidated after the oil or tar is removed. The formation is consolidated oil or bitumen until the oil or bitumen is produced. The problem in tar sands is the undesirable production of sand with the oil or bitumen which is detrimental to most equipment, and particularly to the pumps.

U.S. Pat. No. 3,379,247 circulates hot fluids between lower and upper perforations in a tar sand formation, but it also produces sand with the melted bitumen which is detrimental to most mechanical equipment above, as the hydraulic pumps, etc. Assignee's U.S. Pat. No. 3,913,671 discloses circulating an aqueous heating fluid with sodium hydroxide out upper perforations and in lower perforations after packing through a sand pack. But this disclosure lacks the steps of pouring a cone of graded gravel for building a conical shaped gravel pack and running a screen on the lower end of a production tube down through the apex of the cone to bury the screen in the gravel pack for providing an improved method of sand control and production of bitumen. U.S. Pat. No. 2,905,245 likewise lacks the screen and gravel pack therewith for providing the disclosed improved method for hydrocarbon production in tar sands. U.S. Pat. No. 3,910,351 discloses a pile of granular material around a slotted tube in a cavity, but the granular material fills the cavity completely with no cone for penetration by a screen. U.S. Pat. No. 3,812,913 shows a different method of formation consolidation wherein a bonding agent is applied to the formation.

OBJECTS OF THE INVENTION

Accordingly, a primary object of this invention is to provide an improved process for producing petroleum such as bitumen from a subterrean reservoir of very viscous, semi-solid, immobile hydrocarbon material, such as tar sands, that is economical, practical, and provides uninterrupted and continuous recovery of petroleum from the formation. Another object of this invention is to provide a system for producing bitumen from a subterranean reservoir of tar sands that is practical, economical, and reliable.

Another object of this invention is to provide an improved method for forming a gravel pack cone shaped in a subterranean reservoir of tar sands, that is economical, practical, and reliable.

A further object of this invention is to provide a method and a system for producing bitumen from tar sands and a method for forming an improved gravel pack in tar sands that is cone shaped, all being easy to operate, comprise simple method steps, are economical to utilize and operate, and are of greater efficiency for the production of hydrocarbons.

Other objects and various advantages of the disclosed process and system for producing bitumen from tar sands and a method for forming a gravel pack in tar sands that is cone shaped will be apparent from the following detailed description, together with the accompanying drawings, submitted for purposes of illustration only and not intended to define the scope of the invention, reference being made for that purpose to the subjoined claims.

BRIEF DESCRIPTION OF THE DRAWINGS

The drawings diagrammatically illustrate by way of example, not by way of limitation, one embodiment for carrying out the method of producing bitumen from tar sands wherein like reference numerals have been employed to indicate similar parts in the several views in which.

Figures 1, 2:
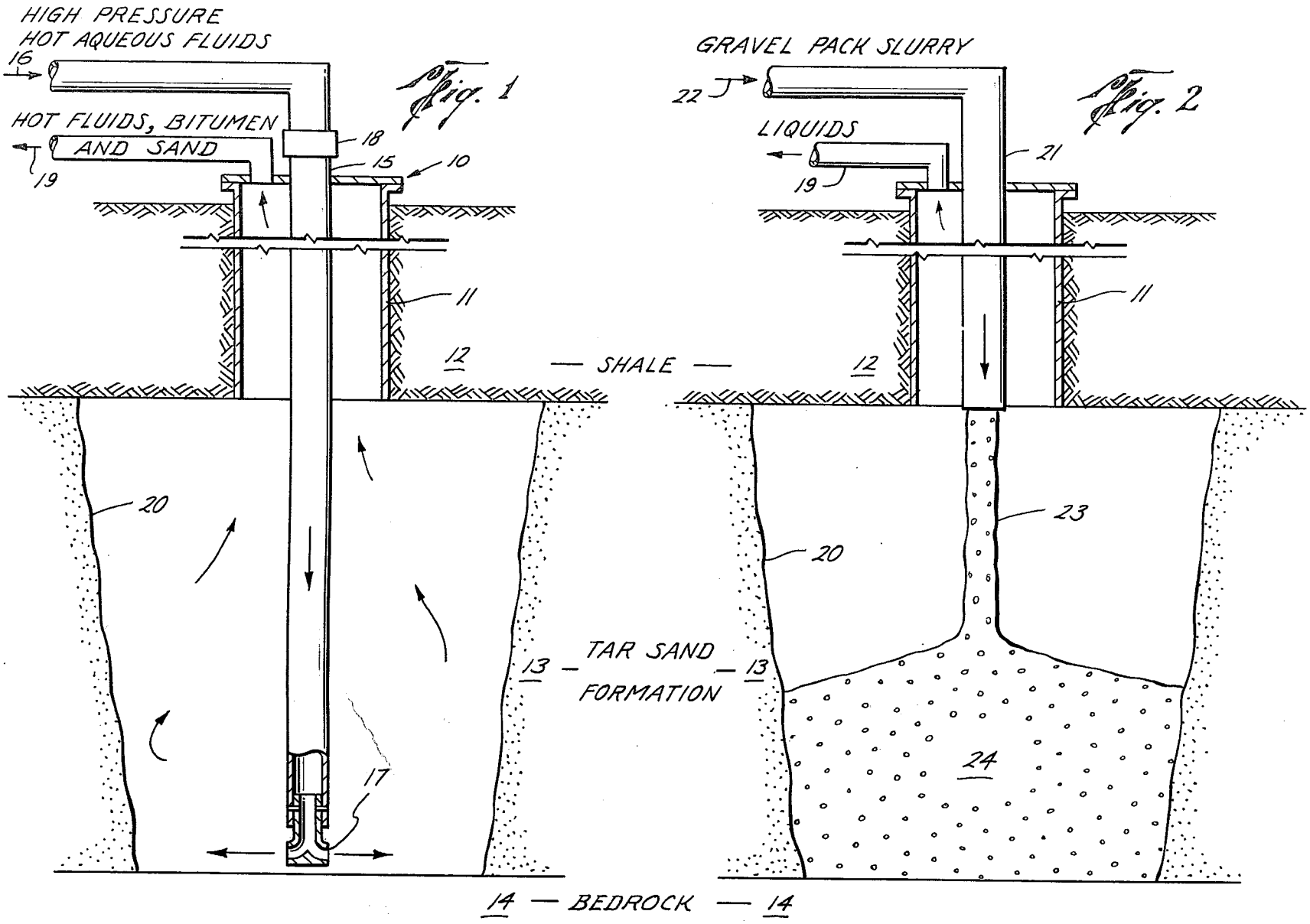
FIG. 1 is a schematic vertical sectional view of a well through a subterranean reservoir of tar sands illustrating the first step of washing out a cylindrical cavity down through the tar sand formation to the bottom thereof.
FIG. 2 is the well of FIG. 1 when pouring the cone of gravel for forming the sand pack in the cavity.

The invention disclosed herein, the scope of which being defined in the appended claims, is not limited in its application to the details of construction and arrangement of parts shown and described for carrying out the disclosed methods, since the invention is capable of other embodiments for carrying out other methods and of being practiced or carried out in various other ways. Also, it is to be understood that the phraseology or terminology employed herein is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

DESCRIPTION OF THE METHODS

This invention comprises at least one process and a system for producing bitumen from tar sands and at least one method for forming a gravel pack in tar sands.

PROCESSES FOR PRODUCING BITUMEN FROM TAR SANDS

One aspect of this invention is the production and recovery of viscous petroleum or bitumen from subterranean viscous petroleum-containing formations including tar sand formations by contacting these immobile hydrocarbon deposits in the formation near the production well to facilitate removal thereof from the formation. Thus in greater detail, one method comprises the process steps of:

(1) lowering a high pressure fluid supply conduit from a pump at the surface down through the casing to the tar sand formation below, (2) supplying a horizontal nozzle on the lower end of the supply conduit with the high pressure fluid, (3) rotating and lowering the nozzle for washing out the cylindrical cavity in the tar sand formation below the well casing down to the bottom of the tar sand formation, (4) lowering a graded gravel supply conduit in the well casing from a pump above at the surface, (5) pouring graded gravel in the bottom of the cylindrical cavity to form a conical shaped gravel pack of a substantial height great enough to cover a screen to be buried therein, (6) securing a cylindrical screen of a length slightly less than the height of the gravel pack cone on the end of the production tube, (7) running the cylindrical screen down through the apex of the cone shaped gravel pack to the bottom of the tar sand formation for ensuring that the screen is buried in the sand pack, (8) forming an annulus around the production tube extending downwardly in the well casing, (9) flowing hot fluids down the annulus in the well around the producing tube,

(10) ejecting the hot fluids into the cavity for melting bitumen from the tar sands,

(11) flowing the melted bitumen through the gravel pack into the screen for filtering out sand and gravel from the melted bitumen, and

(12) flowing the melted bitumen from internally of the screen up the production tube for recovery at the surface.

A SYSTEM FOR PRODUCING BITUMEN FROM TAR SANDS

A system is disclosed for producing bitumen from a subterranean reservoir of tar sands, as unconsolidated oil bearing sands from a well having a casing extending down to the tar sand formation.

FIG. 1 discloses a well 10 having a casing 11 extending down through the usual shale formation 12 for example to a tar sand formation 13, which formation may extend down to bedrock 14. A preferred mechanism for washing out or forming a cavity in the well through the unconsolidated oil bearing or tar sand formation comprises the following elements. A high pressure fluid supply pipe 15 extends from a suitable source 16 on the surface of high pressure, high velocity, hot aqueous fluids, as hot water, down through the well 10 to a hydraulic nozzle 17. Nozzle 17, shown here as a double nozzle, for example, has two 180° oppositely positioned openings for ejecting the high velocity fluids horizontally and is rotatable about bearing housing 18. Thus as the double nozzle ejects hot and high pressure, high velocity fluid in the tar sand formation immediately under the lower end of the casing, the nozzle is slowly rotated and lowered until reaching the lowermost, bedrock position illustrated in FIG. 1. Immediately upon ejection of the hot fluids from the nozzle, a slurry 19 of spent fluids, sand, and bitumen are washed out and up the well to exhaust through a conduit at the surface where the bitumen is recovered therefrom. After a cavity 20 is formed, the nozzle 17 and supply pipe 15 are removed.

In the next basic method step, a gravel pack slurry supply pipe 21, FIG. 2, is lowered into the well from a suitable source of graded gravel 22 at the surface. A predetermined amount of graded gravel pack slurry 23, substantially less than the amount of sand and bitumen removed when forming the cavity, is measured out. A stream of the gravel pack slurry 23 is poured down into the cavity 20, FIG. 2. The resulting cone shaped mound on sand pack 24 is formed on the surface of the bedrock 14. Surplus fluids in the cavity 20 are pushed out exhaust conduit 19, FIG. 2.

The natural slope of a typical conical "pile" of wet sand is 22° as verified by the National Tank Company Handbook. Small graded gravel, such as what passes through a 20–40 [holes per linear inch (2.5 cm)] mesh, i.e. for fine aggregates, is sand.

Figure 3:
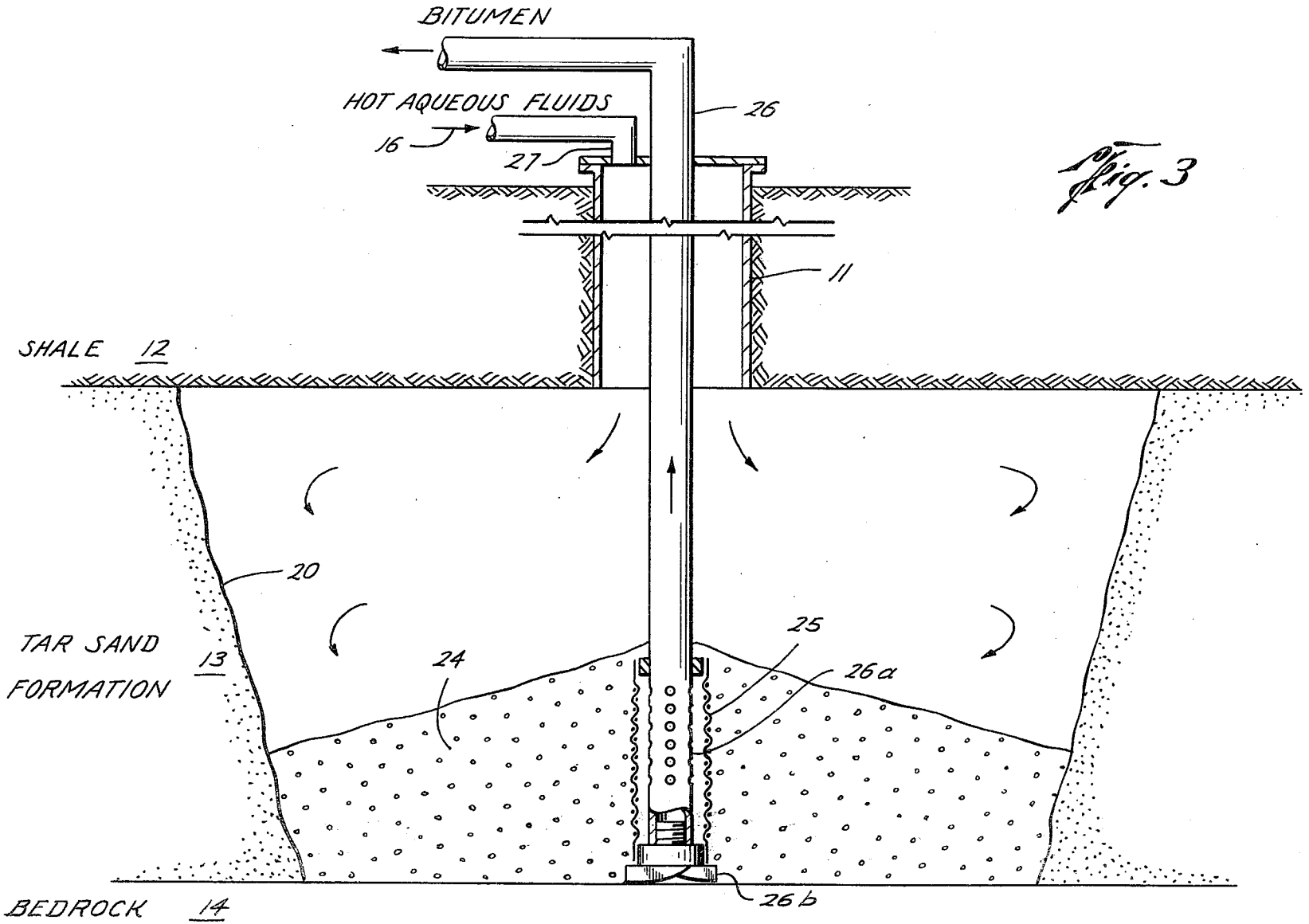
FIG. 3 is the well of FIG. 2 after the screen is buried in the cone and the sand pack is finished and bitumen is being produced with the circulation of hot fluids.

FIG. 3 illustrates the system for producing bitumen from tar sands in its last stage of being formed. After the conical shaped gravel pack 24 is poured, a sieve or screen 25 is buried in the center of the vertex of the cone to the bottom or bedrock. The illustrated screen 25 preferably has a screw bit or muleshoe thread **26*b* fixed to the bottom thereof for facilitating boring of the screen down through the vertex of the cone. Alternately, the screen may be driven down vertically into the vertex of the cone for being buried therein. A production tube or string 26 is lowered to the bottom from a tank on the surface with the cylindrical screen 25 mounted over a perforated lower end 26*a* of the production string. In the configuration of FIG. 3, the high pressure hot aqueous fluids are supplied from a suitable source 16 on the surface for passing through injection tube 27 to the well casing 11 from which the hot fluids are ejected into the well cavity 20 for melting and flowing the melted bitumen and tar sands from the tar sand formation through the gravel pack 24 toward the screen 25. Only the melted bitumen and wash fluids pass through the gravel pack, screen, and perforated production tube end for passing up through the production string 26** to the collection tank at the surface.

A typical formation with the completed gravel pack 24 is illustrated in FIG. 3 for a 2-inch diameter production tube. Here the oil bearing formation is 20 feet (6 meters) thick and the gravel pack 24 has a height of 6 feet (1.8 meters) and a radius of 15 feet (4.5 meters). The volume is 1385 cubic feet (39.57 cubic meters).

In tar sand formations as unconsolidated oil bearing sands, the conventional gravel pack over the screen utilizes a small size gravel to prevent oil sand flow which results in low oil flow provides too low oil flow for good commercial production. This invention overcomes this problem by providing a larger surface area of the gravel pack for formation fluids to flow through. This larger surface is the surface of the cone shaped gravel pack, i.e. about 761.5 square feet (68.5 square meters) in the example. The surface of the conventional cylinder gravel pack having a 2-foot diameter and a 6-foot height is 37.7 square feet, about 1/20th the area of the new gravel pack. Thus for the same gravel pack permeability, the well productivity is greatly increased.

METHOD FOR FORMING A GRAVEL PACK IN TAR SANDS

A problem in producing hydrocarbons from wells having unconsolidated oil bearing sands with little mechanical competency is finding a method for forming a gravel pack that is a permanent competent immobile pack even when there is no competent matrix to support it. The disclosed method comprises the steps of, (1) lowering a high pressure fluid nozzle from the well for washing a cylindrical cavity down through the tar sand formation in the bottom thereof, (2) pouring graded gravel for building a conical shaped gravel pack of substantial height in the cavity, (3) lowering and rotating the nozzle about a vertical axis for washing out the cylindrical cavity in the tar sand formation below the well casing down to the bottom of the tar sand formation, (4) lowering a graded gravel supply conduit in the well casing from a gravel source above at the surface, (5) pouring graded gravel in the bottom of the cylindrical cavity to form a conical shaped gravel pack at a substantial height great enough to cover a screen to be buried therein, (6) securing a cylindrical screen of a length slightly less than the height of the gravel pack cone on the end of the production tube, and (7) running the cylindrical screen down through the apex of the cone shaped gravel pack to the bottom of the tar sand formation for ensuring that the screen is buried in the sand pack.

Accordingly, it will be seen that a method for producing bitumen from tar sands, a system for producing bitumen from tar sands, and a method for forming a gravel pack in tar sands have been described which will operate in a manner which meets each of the objects set forth hereinbefore.

While only a few methods of the invention have been disclosed, it will be evident that various other methods and modifications are possible without departing from the scope of the invention and it is accordingly desired to comprehend within the purview of this invention such methods and modifications as may be considered to fall within the scope of the appended claims.

While FIG. 3 illustrates a small diameter conical gravel pack 29, in deeper tar sand formations the cavity 20 is preferably larger in diameter to accommodate a larger gravel pack having a shape forming a complete cone.

We claim:

1. A process for producing bitumen from a subterranean reservoir of tar sands as unconsolidated oil bearing sands from a well having a casing extending down to the tar sand formation comprising the steps of, (a) lowering a high pressure fluid nozzle from the well for washing a cylindrical cavity down through the tar sand formation to the bottom thereof, (b) pouring graded gravel for building a conical shaped gravel pack of substantial height in the cavity, (c) securing a cylindrical screen of a length slightly less than the height of the gravel pack cone on the end of the production tube, (d) securing a screw bit to the bottom of the cylindrical screen of a diameter substantially larger than that of the screen, (e) screwing the screw bit and the cylindrical screen down through the apex of the cone shaped gravel pack to the bottom of the tar sand formation for ensuring that the screen is buried in the sand pack, (f) ejecting hot fluids into the cavity for melting bitumen from the tar sands, and (g) flowing the melted bitumen through the gravel pack and screen for filtering out sand and gravel from the melted bitumen for recovering the bitumen at the surface.

2. A method for forming a gravel pack for producing bitumen from a subterranean reservoir of tar sands as unconsolidated oil bearing sands from a well having a casing extending down to the tar sand formation comprising the steps of, (a) lowering a high pressure fluid nozzle from the well for washing a cylindrical cavity down through the tar sand formation to the bottom thereof, (b) pouring graded gravel for building a conical shaped gravel pack of substantial height in the cavity, (c) securing a cylindrical screen of a length slightly less than the height of the gravel pack cone on the end of the production tube, (d) fastening a screw bit to the bottom of the cylindrical screen of a diameter substantially larger than that of the screen, and (e) screwing the screw bit and the cylindrical screen down through the apex of the cone shaped gravel pack to the bottom of the tar sand formation for ensuring that the screen is buried in the sand pack.

* * * * *